US006178745B1

(12) United States Patent
Meusen

(10) Patent No.: US 6,178,745 B1
(45) Date of Patent: Jan. 30, 2001

(54) EXHAUST ASSEMBLY FOR USE WITH COMBUSTION ENGINES, AND VEHICLE PROVIDED WITH SUCH ASSEMBLY

(76) Inventor: Wilhelmus Lambertus Arnoldus Meusen, Pastoor Vranckenlaan 49, Reuver (NL), 5953

( * ) Notice: Under 35 U.S.C. 154(b), the term of this patent shall be extended for 0 days.

(21) Appl. No.: 09/171,571

(22) PCT Filed: Apr. 21, 1997

(86) PCT No.: PCT/NL97/00204

§ 371 Date: Jan. 27, 1999

§ 102(e) Date: Jan. 27, 1999

(87) PCT Pub. No.: WO97/40264

PCT Pub. Date: Oct. 30, 1997

Related U.S. Application Data

(60) Provisional application No. 60/016,120, filed on Apr. 24, 1996.

(30) Foreign Application Priority Data

Apr. 22, 1996 (NL) ..... 1002921

(51) Int. Cl.[7] ..... F02B 27/02

(52) U.S. Cl. ..... 60/312; 60/324; 181/241; 181/253; 181/254

(58) Field of Search ..... 60/312, 311, 313, 60/324, 323; 181/236, 237, 240, 241, 253, 254

(56) References Cited

U.S. PATENT DOCUMENTS

| | | | | |
|---|---|---|---|---|
| 951,770 | * | 3/1910 | Miller | 181/253 |
| 981,584 | * | 1/1911 | Miller | 181/253 |
| 1,591,088 | | 7/1926 | Holms . | |
| 2,072,372 | | 3/1937 | Kingsley . | |
| 2,382,159 | * | 8/1945 | Klemm | 181/241 |
| 3,042,138 | * | 7/1962 | Reinert | 181/241 |
| 3,141,519 | * | 7/1964 | Bottum | 181/241 |
| 4,901,528 | | 2/1990 | Saigo et al. . | |
| 4,913,260 | * | 4/1990 | Fallon | 181/254 |
| 5,692,374 | * | 12/1997 | Seki et al. | 60/312 |
| 5,921,081 | * | 7/1999 | Kim | 60/324 |

FOREIGN PATENT DOCUMENTS

| | | | |
|---|---|---|---|
| 25 14 689 | | 10/1976 | (DE) . |
| 764504 | | 5/1934 | (FR) . |
| 446914 | * | 5/1936 | (GB) . |
| 748053 | * | 4/1956 | (GB) . |
| 4-175412 | * | 6/1992 | (JP) . |

* cited by examiner

*Primary Examiner*—Thomas Denion
*Assistant Examiner*—Tu M. Nguyen
(74) *Attorney, Agent, or Firm*—Michaelson & Wallace; Peter L. Michaelson

(57) ABSTRACT

An exhaust assembly for use with a motor vehicle having a combustion engine. The exhaust assembly includes an exhaust and a muffler having first and second gas flow routes. A control device controls the damping characteristic of the exhaust assembly by selectively dividing the gas flow by different amounts between the different gas flow routes. The control device, which may include a valve or a sliceable sleeve, is selectively operable by a user manually or electronically while the combustion engine is operating.

9 Claims, 3 Drawing Sheets

EXHAUST ASSEMBLY FOR USE WITH COMBUSTION ENGINES, AND VEHICLE PROVIDED WITH SUCH ASSEMBLY

This application is a 371 of PCT/NL97/00204 filed Apr. 21, 1997 and also claims the benefit of U.S. Provisional No. 60/016,120 filed Apr. 24, 1996.

The invention relates to an exhaust assembly of the type described in the preamble of the main claim. Such assembly is known from U.S. Pat. No. 4,901,528.

The known assembly comprises a first exhaust manifold and a second exhaust manifold, joined at a predetermined portion and having different fluid flow paths in length down to said predetermined portion, a silencer being connected to said first and second exhaust manifolds at said portion. The silencer includes selector valve means for altering the exhaust resistance thereof. Furthermore means are provided for detecting engine revolution speed and engine load, which can each send a signal to control means responsive to said signals for normally closing said selector valve, but opening said valve when the engine revolution speed and load exceeds a first predetermined level. A controller is provided for automatically opening said valve for reducing the noise and resonance created by the motor.

This known exhaust assembly has the disadvantage that the noise characteristics of the exhaust assembly will be automatically regulated. The driver of the motor vehicle cannot influence the characteristics of the sound made by the vehicle at will. Thus with such known exhaust assembly it will not be possible to for example set the sound characteristics based on legal noise standards or personal preferences.

A further exhaust assembly is known from practice and is supplied in the Netherlands by the firm Dreyson of Uden.

This known assembly comprises an exhaust connectable to an engine of, in particular, a motorbike, which exhaust consists of a pipe having a muffler included therein. Adjacent the end of the exhaust which, during use, is remote from the engine, a series of disks is included. During use of the engine, the exhaust gases are guided along the disks, creating a particular damping characteristic, depending on the number of disks arranged one behind the other. In order to adjust the damping characteristic, disks can be added or removed, both of which influence in particular the noise produced during use and the back pressure of the exhaust. In order to change the number of disks in this exhaust assembly, a series of fastening screws should be unscrewed, after which disks can be removed or added. Then, the fastening screws should be placed back again, possibly after replacement by screws of a different length. Next, the engine can be started again for checking the change of the damping characteristic, after which, if necessary, the number of disks should be adjusted once again. In this manner, the suitable number of disks can iteratively be determined. A major drawback of this assembly is that each time when the damping characteristic is to be adjusted, the engine should be switched off and the above series of operations should be performed, usually a number of times in succession, while, moreover, replacement parts and tools are necessary. As a consequence, the means for adjusting the damping characteristic are unsuitable for quickly and readily adjusting the damping characteristic. In particular, this cannot be performed with a switched-on engine, as the pressure and temperature of the combustion gases are so high that handling the exhaust assembly, in particular the inside thereof, is not possible without the danger of burning oneself.

The object of the invention is to provide an assembly of the type described in the preamble of the main claim, in which the drawbacks mentioned are avoided and the advantages thereof are retained. To that end, an exhaust assembly according to the invention is characterized by the features of the characterizing part of claim 1.

An exhaust assembly according to the invention comprises at least a first and a second combustion gas flow route. During use, when two different combustion gas flow routes are present, the combustion gases are selectively guided via the first, partly via the first and partly via the second, or, possibly, entirely via the second combustion gas flow route. By operating the control means, the ratio between the amount of combustion gases flowing via each of the combustion gas flow routes can be set, during use. If for instance 100% of the combustion gases is guided via the first combustion gas flow route, the damping characteristic of the exhaust assembly is determined by the damping characteristic of the first combustion gas flow route. However, if a portion of the combustion gases is guided along the second combustion gas flow route, a damping characteristic is created which is a combination of the damping characteristics of the two combustion gas flow routes. In this manner, the exhaust noise can for instance be controlled by operating the control means.

As the combustion gas flow routes in the exhaust assembly are defined and can be switched on selectively without requiring disassembly and assembly operations and the like, the noise produced by a vehicle in which the exhaust assembly is used can, during use, in each case be adjusted as desired or as necessary, in respect of pitch and key as well as volume. This is in particular very advantageous if the vehicle is for instance used in areas where different or changing noise standards prevail for the allowed noise production by a vehicle, such as a border region where the border is passed. Further, an exhaust assembly according to the invention offers the advantage that if different users of a vehicle have different noise preferences or if users have different noise preferences at different moments and in different situations, the noise can readily be adjusted during use. Moreover, with an exhaust assembly according to the invention, adjustment of the back pressure provided by the exhaust assembly can be effected in a simple manner and during use. All this can be realized while retaining the possibility of getting back without any difficulty the noise that is considered authentic, if so desired.

In an advantageous embodiment, an exhaust assembly according to the invention is characterized by the features of claim 2.

In such assembly, different exhausts can be used that can selectively be actuated, for processing the complete flow of combustion gases or a portion thereof. This for instance involves the first combustion gas flow route comprising a first exhaust and the second combustion as flow route comprising another exhaust. One of the exhausts may for instance be the officially allowed standard exhaust and the other exhaust a custom exhaust.

In a further advantageous elaboration, an assembly according to the invention is characterized by the features of claims 3 and 4.

The valve means provide the advantage that in a simple manner, a suitable choice between the exhausts present can in each case be made. By means of the valve means, the complete flow of combustion gases can be guided through one of the exhausts or be distributed over a series of exhausts. By providing the manifold with passages having different flow resistances, the advantage is achieved that the valve means need only be arranged in the passage having the lowest flow resistance. After all, if both passages are released, the combustion gases will in each case at least substantially choose the passage having the lowest resistance. Only when that passage is closed will the combustion gases be guided via the second or further passage. As a result, constructionally simple, robust and readily operable valve means can be used that are little susceptible to, for instance, deposit formation and damage.

In an alternative embodiment, an exhaust assembly according to the invention is characterized by the features of claim 6.

During use, the covering means release a portion of a muffler for being flown through by the combustion gases. Upon the release of a larger portion of the muffler, at least a greater damping, less noise and a change of the back pressure will be created. Accordingly, a variation in the damping characteristic of the exhaust assembly can already be obtained with one exhaust, which variation can be controlled during use.

In a further embodiment, an exhaust assembly according to the invention is characterized by the features of claim 8.

During use, the combustion gases of the combustion engine flow through and around the muffler elements. In this connection, the interspace between the muffling elements is substantially the determining factor for the degree of damping and, accordingly, the damping characteristic of the exhaust assembly. Hence, by increasing or reducing this interspace at least at a number of muffling elements, a variable damping characteristic is obtained during use in a simple manner and by constructionally simple means. The muffler elements can for instance be disk-shaped and be forced apart by spring means, with pulling means being provided for moving the muffler elements towards each other.

In further elaboration, an exhaust assembly according to the invention is preferably characterized by the features of claim 9.

As the means for controlling the damping characteristic are remotely controllable, the advantage is achieved that these means and, accordingly, the damping characteristic, are for instance controllable from a driver's position of a vehicle provided with the exhaust assembly, so that the damping characteristic can be adjusted during use without the vehicle having to be brought to a stop therefor. Moreover, this does not involve the danger of the burning of parts of the body and clothes and the like of the person who operates the means. Moreover, this enables fine-tuning of the noise in a simpler manner.

The invention further relates to diversion and switching means and a manifold for use in an exhaust assembly according to the invention.

The invention moreover relates to a vehicle comprising an exhaust assembly according to the invention, in particular a motorbike, moped or motorcar.

To explain the invention, exemplary embodiments of an exhaust assembly will hereinafter be described with reference to the accompanying drawings. In these drawings.

Figure 1:
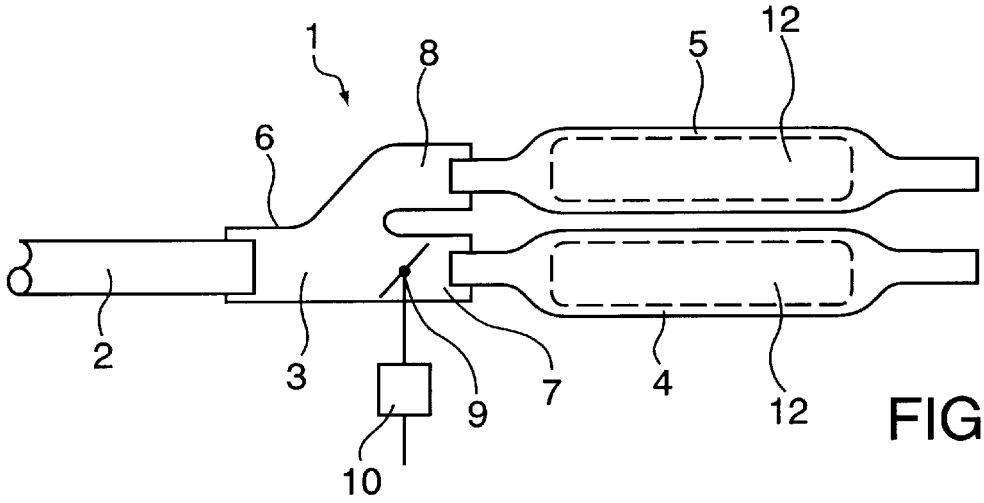
FIG. 1 shows, in side elevation, a first embodiment of an exhaust assembly, with its housing partly broken away.

FIG. 1 shows in side elevation an exhaust assembly 1 comprising a feed pipe 2, a manifold 3, a first exhaust 4 and a second exhaust 5. During use, the feed pipe 2 has a first end connecting to a combustion engine, not shown, for instance a two-stroke or four-stroke engine of a motorbike or motorcar. At the opposite second end, the feed pipe 2 connects to a first connecting stub 6 of the manifold 3. At the side facing away from the first connecting stub 6, the manifold 3 comprises a second connecting stub 7 and, located thereabove, a third connecting stub 8. The first exhaust 4 connects to the second connecting stub 7, the second exhaust 5 connects to the third connecting stub 8.

Figure 1A:
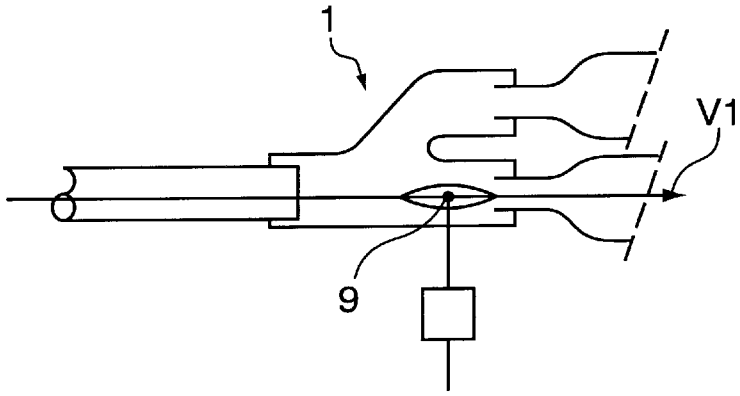
FIG. 1A shows the exhaust assembly according to FIG. 1 with the first combustion gas flow route set.
Figure 1B:
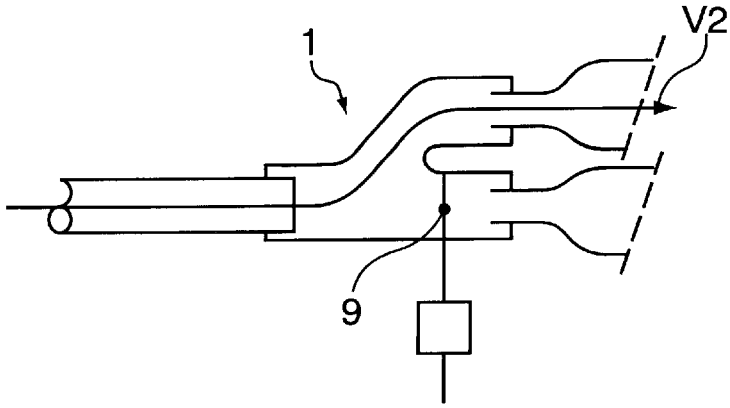
FIG. 1Bshows the exhaust assembly according to FIG. 1 with the second combustion gas flow route set.

The first 6 and second exhaust stub 7 are directly opposite each other, with the first flow passage therebetween being straight. In FIG. 1A, the first combustion gas flow route $V_1$ is shown, which in itself has a relatively low flow resistance. The first 6 and third connecting stub 8 are positioned obliquely above and/or next to each other, in such a manner that the second flow passage therebetween is curved. In FIG. 1B, the second combustion gas flow route $V_2$ is shown, which in itself has a relatively high flow resistance. Hence, the manifold 3 is slightly Y-shaped.

Figure 6:
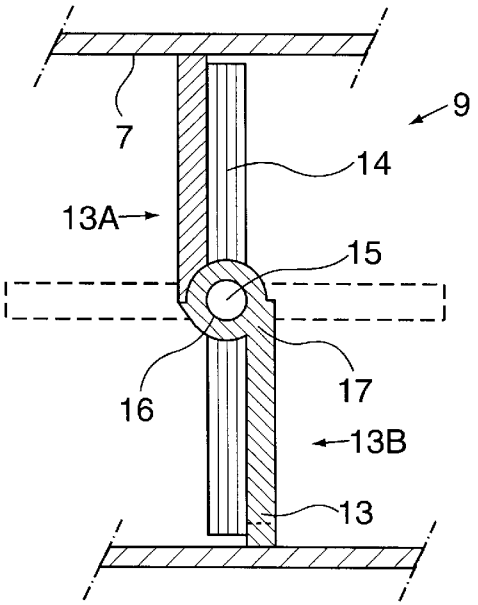
FIG. 6 shows a valve for use in an exhaust assembly according to the invention.

Accommodated in or adjacent the second connecting stub 7 is a valve 9 which, by means of a schematically shown servo control 10, is tiltable within the connecting stub 7 between a first extreme position in which the passage of the second connecting stub 7 is at least substantially completely released (FIG. 1A), and a second extreme position in which the second connecting stub 7 is at least substantially completely closed (FIG. 1B). Because when the valve 9 is in the first position (FIG. 1A) the flow resistance of the first combustion gas flow route $V_1$, is much lower than that of the second combustion gas flow route $V_2$, the combustion gases of the combustion engine will during use be discharged almost entirely via the first combustion gas flow route $V_1$, i e. through the first exhaust 4. Hence, the damping characteristic of the exhaust assembly is then almost entirely determined by the first exhaust 4. When the valve is in the second position (FIG. 1B), the combustion gases cannot be guided via the first exhaust 4, so that they are guided along the second exhaust 5. The damping characteristic of the exhaust assembly is then almost entirely defined by the second exhaust 5, FIG. 6 schematically shows a valve 9 for use in an exhaust assembly according to the invention. The valve 9 comprises an annular valve seat 13 that can fittingly be disposed within for instance the connecting stub 7. The valve seat 13 comprises a top half 13A which is shifted in axial direction of the connecting stub 7 relative to the bottom half 13B of the valve seat, through a distance approximately corresponding to the thickness of the valve body 14. The valve body 14 is disk-shaped and is rotatable by means of a pivot 15 rotatably suspended in bearings 16 in the connecting piece 17 between the two valve seat halves 13A and 13. The pivot 15 projects from the stub 7 at least on one side. FIG. 6 shows the valve body 14 in the closed position (FIG. 1B) in full lines, in the completely open position (FIG. 1A) in broken lines. In the closed position, the valve body 14 abuts against the sides of the top 13A and bottom halves 13B of the valve seat 13 that are located on the side of the pivot. Such valve 9 is easy to manufacture, incorporate and operate, is robust and little susceptible to for instance fouling, in particular carbonization, and is resistant to the exhaust pressures.

The first exhaust 4 can for instance be a standard exhaust, legally permitted in a first country, with a maximum noise volume meeting the legal requirement prevailing in that country, while the second exhaust 5 can for instance be an exhaust which is legally permitted in another, for instance adjoining, second country. For that purpose, both exhausts are for instance provided with different mufflers 12. At a border between the two countries mentioned, the valve 9 can then be moved into one of the extreme positions by means of the switching means 10, in such a manner that the exhaust 4 or 5 allowed in the country to be entered, i.e. the combustion gas flow route $V_1$, or $V_2$, is switched on. Optionally, the valve 9 can be moved into an intermediate position, so that a first part of the combustion gases are guided via the first combustion gas flow route $V_1$, while the rest of the combustion gases are guided via the second combustion gas flow route $V_2$. This creates a combination of damping characteristics of the two exhausts 4, 5, depending on the distribution of the combustion gases. Of course, other or more exhausts can be combined as well, for instance a standard exhaust and an open-flow exhaust.

Of course, other exhausts 4, 5 can also be fitted, for instance an exhaust having a maximum damping and an exhaust having a minimum damping or an exhaust having a normal noise and an exhaust having a sporty noise. Further, by means of the valve 9, the back pressure of the exhaust assembly 1 can be controlled, which may provide an additional advantage for better engine achievements.

It is preferred when the valve 9 is driven by the servo control 10 by means of a belt drive or the like. In particular when two or more of such exhaust assemblies 1 are fitted to one vehicle, this provides the advantage that during the control of the exhaust assemblies 1, the valves 9 can first be controlled in an extreme position, for calibration, with slip of the belt drive ensuring that the valves 9 are not damaged, after which the valves 9 can be moved into the desired position. Thus, it is provided that the valves 9 all assume the same position. Moreover, it is advantageous when the or each valve 9 is or can be biased in the direction of one of the extreme positions, in such a manner that a standard or preferred exhaust is in principle incorporated into the switched-on combustion gas flow route V, while a different exhaust must be connected consciously. This prevents a non-allowed exhaust from being switched on unintentionally.

Figure 2:
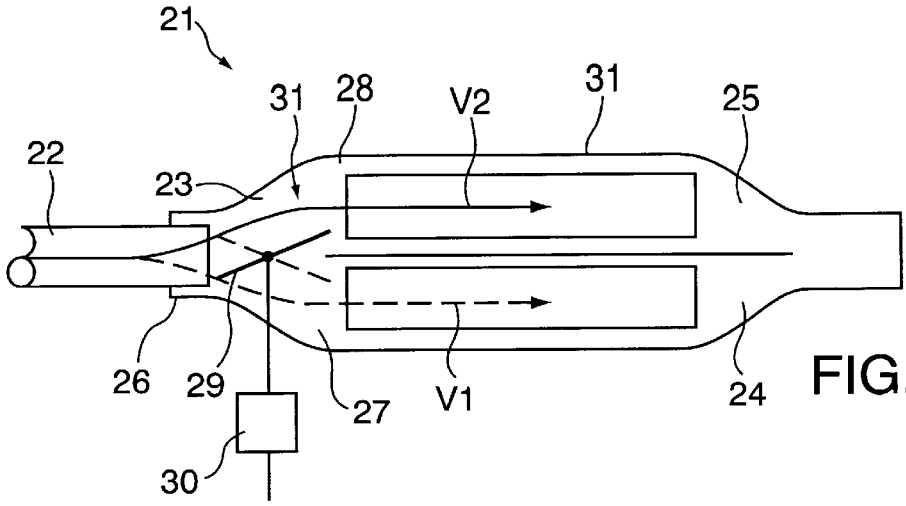
FIG. 2 shows, in side elevation, a second embodiment of an exhaust assembly, with its housing partly broken away.

FIG. 2 shows an alternative exhaust assembly 21, in which the first 24 and second exhaust 25 are jointly accommodated in one exhaust housing 31. In this embodiment, the valve 29, again operable by means of the servo control 30, is arranged in the integrated manifold 23, between the first connecting stub 26, the second connecting stub 27 and the third connecting stub 28. The valve 29 is adapted to direct combustion gases that are fed during use via feed pipe 22 and the first connecting stub 26, in the direction of the first exhaust 24 and/or the second exhaust 25. Thus, the first and second combustion gas flow routes or a combination thereof can be switched on. Such embodiment has the advantage that it is relatively compact and has only one housing 31, which is attractive because of the outward appearance of the assembly and a vehicle provided therewith.

Figure 3:
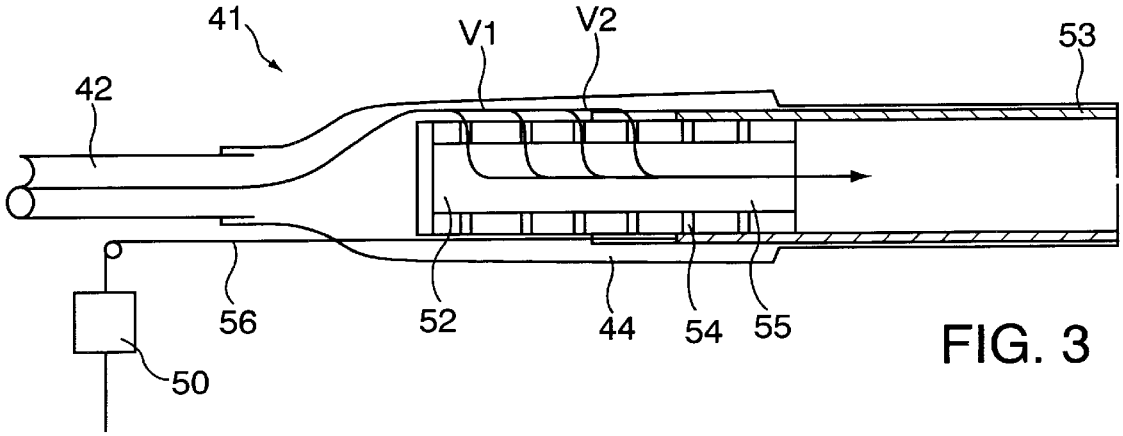
FIG. 3 shows, in side elevation, a third embodiment of an exhaust assembly, with its housing partly broken away.

FIG. 3 shows a third embodiment of an exhaust assembly 41 according to the invention. In this embodiment, one exhaust 44 is provided, which exhaust directly connects to the feed pipe 42. Provided in the exhaust 44 is a substantially cylindrical muffler 52 around which a tubular shell 53 is slidably fitted. The muffler is provided with passages for the combustion gases of the engine, schematically shown by the openings 54 and the central passage 55 in the muffler 52. The shell 53 abuts against the outside of the muffler 52 in such a manner that through displacement of the shell 53, openings 54 can be closed or released. For displacing the shell 53, a servo control 50 is included again, connected to the shell 53 via a drivable pull-push rod 56. The number of passages in the muffler 52 released by the shell 53 at least partly determines the damping characteristic of the exhaust assembly 41. In this embodiment, an extremely compact exhaust assembly is obtained which is moreover of a simple construction.

Figure 4:
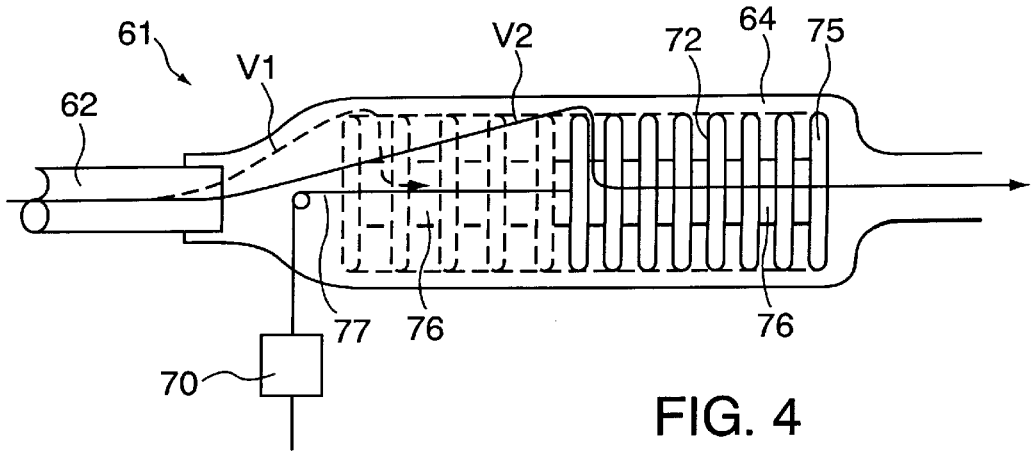
FIG. 4 shows, in side elevation, a fourth embodiment of an exhaust assembly, with its housing partly broken away.

FIG. 4 shows a fourth embodiment of an exhaust assembly 61, again provided with one exhaust 64 that is directly connected to the feed pipe 62. Accommodated in the exhaust 64 is again a muffler 72, which in this embodiment comprises a number of disk-shaped muffler elements 75 arranged one behind the other, in each case with the interposition of a pressure spring 76. Extending through the muffler elements 75 is a pull member 77, operable by the schematically shown servo control 70. By means of the pull member 77, for instance a pull rod, the muffler elements 75 can be pulled closer together, in such a manner that during use, the muffler 72 forms a higher flow resistance for the combustion gases of the combustion engine. When the muffler elements 75 are pulled together, the pressure springs are compressed so that when the pull member 77 is released, the muffler elements adopt the maximum mutual distances again and, accordingly, the lowest flow resistance In this manner, the damping characteristic of the exhaust assembly is readily settable.

Figure 5:
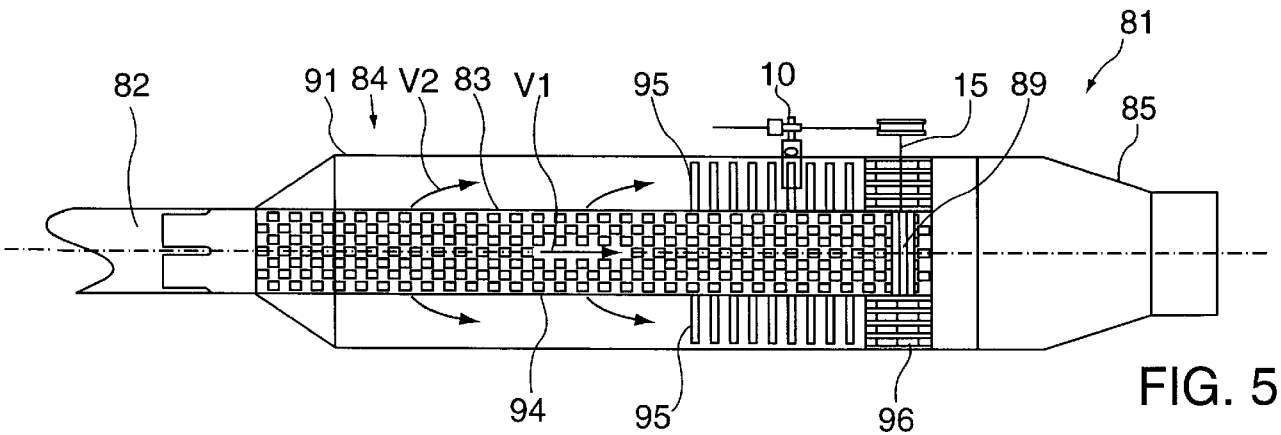
FIG. 5 shows, in sectional side elevation, a preferred embodiment of an exhaust assembly of a one-pipe construction.

FIG. 5 shows a particularly advantageous one-pipe embodiment of an exhaust assembly 81 according to the invention. In this embodiment, the exhaust assembly 81 comprises one exhaust 84 that is directly connectable to the feed pipe 82, which exhaust comprises a housing 91 and a perforated tube 83 centrally arranged therein and extending in the longitudinal direction, which tube, in assembled condition, has one side connecting to the feed pipe 82 and has the other side opening into an exhaust piece 85. On the side located adjacent the exhaust piece 85, a valve 89 is provided in the tube 83, which valve in a first position closes the free passage of the tube 83 and in a second position substantially releases it. The tube 83 is surrounded with space by the housing 91, which, adjacent the feed pipe 82, closes tightly around the tube 83 and is in flow connection with the exhaust piece 85, around and downstream of the tube 83. The valve 89 is in the above-described manner operable, through servo control 10 and pivot 15, between the first and the second position. Adjacent the end located on the side of the exhaust piece 85, a number of for instance disk-shaped muffler elements 95 are provided around the tube 83, which muffler elements provide for noise adjustment and reduction and possibly power limitation when exhaust gases are guided therealong. An exhaust assembly 81 according to FIG. 5 can be used as follows.

The exhaust assembly 81 is connected to a feed pipe 82 in such a manner that combustion gases of an engine can be guided into the perforated tube 83 via the feed pipe 82. The valve 89 is then moved into the second position, enabling the combustion gases to be discharged to the environment via the tube 83 and the exhaust piece 85 practically without any resistance. In FIG. 5, this flow is shown by the arrow V1. This involves the generation of a first, relatively loud "engine" noise.

When the valve 89 is controlled so as to be partly or completely closed, the back pressure in the tube 83 is increased, whereby a part of the or all combustion gases are forced between the tube 83 and the housing 91 via the perforation openings 94 in the inner tube 83. There, these gases are subsequently forced along the muffler elements 95 and discharged, via the exhaust piece 85, to the environment. Because of the flow path V2 via the perforations and the muffler elements, a change and reduction of noise and, possibly, a reduction of power is provided. Through a suitable selection of, inter alia, the muffler elements 95 and the laminations 96 around the valve 89, a particular maximum noise volume can be set at a closed valve 89, for instance 81 dB.

In fact, in a comparable manner, several tubes can be connected around and behind one another, enabling further adjustment of noise and power. Moreover, electronic registration means can for instance be provided for measuring the noise of the engine or exhaust, while setting and regulating means can be provided for (semi-)automatically controlling the relevant exhaust assembly.

Adjustment of the damping characteristic should at least be understood to mean adjustment of the noise level produced by or via the exhaust assembly and/or the back pressure provided for the engine by the exhaust assembly, both during the use of the exhaust assembly.

An exhaust assembly according to the invention is in particular suitable for use with a motorbike, a moped or a motorcar. This may involve different assemblies being used side by side, for instance one per cylinder of the engine of the relevant vehicle, or in an integrated manner.

The invention is by no means limited to the embodiments shown and described in the drawings and the specification. Many variations thereto are possible For instance, three or more exhausts having different or comparable damping characteristics may be used, while switching means may be provided for switching on each of the exhausts separately or combinations thereof. Moreover, different combinations of the features given in the specification and the claims are possible in manners speaking for themselves. Various other means for adjusting the damping characteristic of an exhaust assembly in a comparable manner may be used, depending on the type of exhaust opted for. In particular when an exhaust assembly according to the invention is used with a motorcar, the means for controlling the damping characteristic may be incorporated downstream of the first and any further mufflers (dampers) and a catalyst, if any, which saves costs and space.

These and many comparable modifications and variations are understood to fall within the framework of the invention.

What is claimed is:

1. An exhaust assembly for use with a motor vehicle having a combustion engine, said exhaust assembly comprising combustion engine connection means, at least one exhaust and at least one muffler, wherein means are provided for controlling the damping characteristic of said exhaust assembly, wherein said exhaust assembly comprises a housing and an inner tube extending coaxial inside said housing, said inner tube being provided with perforations, a valve provided inside said inner tube, said valve operable between open and closed positions at will by an operator, independently from any gas pressure inside said inner tube and said housing, such that, when said valve is in said closed position, exhaust gases are forced through said perforations into a ring-shaped space between said inner tube and said housing and out of said exhaust assembly, whereas, when said valve is open, said exhaust gasses leave said exhaust assembly primarily through said inner tube along an unobstructed linear path.

2. An exhaust assembly for use with a motor vehicle having a combustion engine, said exhaust assembly comprising combustion engine connection means for communicating with a gas feed pipe, at least one exhaust and at least one muffler, wherein means are provided for controlling the damping characteristic of said exhaust assembly, wherein said exhaust assembly comprises at least a first combustion gas flow route and a second combustion gas flow route, wherein the means for controlling the damping characteristic are operable during use with said combustion engine coupled thereto and are adapted to guide the combustion gases of the engine at least partly along one of said combustion gas flow routes, and wherein said exhaust assembly comprises a gas-tight housing and a perforated inner tube spaced therefrom, wherein said housing is at one end closed around said inner tube at said connecting means, and wherein a valve means, spaced from said connecting means, mounts in said inner tube for closing said inner tube completely or partly, the arrangement being such that when said valve means is open, said first combustion gas flow route extends directly through said inner tube to the environment, while when said valve means is closed, said second gas flow route extends, via said inner tube and said perforated openings, between said inner tube and said housing to the environment.

3. An exhaust assembly according to claim 2, wherein said means for controlling said damping characteristic are operable at will, independently from exhaust gas pressure, wherein said first combustion gas flow route is substantially straight and said second combustion gas flow route comprises only changes in direction of flow of less than 180 degrees.

4. An exhaust assembly according to claim 3, wherein said valve means, when closed, blocks said inner tube such that said combustion gasses are forced through perforations in said inner tube, into a ring-shaped space between said inner tube and said housing, and out of said housing without re-entering said inner tube.

5. An exhaust assembly for use with a motor vehicle having a combustion engine, said exhaust assembly comprising:

an elongated exhaust tube having a gas input end and an opposed gas output end, and a perforated tubular wall defining an unobstructed passageway extending linearly between said input end and said output end;

an elongated housing having a gas-impervious tubular wall surrounding said elongated exhaust tube to form an elongated ring-shaped muffler chamber with opposed first and second ends, said first end of said chamber forming a gas tight seal with said exhaust tube and said second end of said chamber forming a ring-shaped gas discharge opening surrounding said gas output end of said exhaust tube;

muffler means mounted in said ring-shaped muffler chamber for muffling sounds carried by combustion gasses passing into said muffler chamber via said perforated tubular wall;

a tubular exhaust piece connected to said housing at said second end of said muffler chamber, said exhaust piece having a hollow interior in communication with said gas discharge opening and said gas output end of said exhaust tube for directing combustion gasses out of said exhaust assembly; and a control means mounted on said exhaust tube for selectively controlling the damping characteristic of said exhaust assembly by selectively causing different amounts of combustion gasses to flow to said exhaust piece via first and second routes, said first route defined by said exhaust tube and said gas output end of said exhaust tube, and said second route defined by a portion of said exhaust tube, said perforated tubular wall, said ring-shaped muffler chamber and said ring-shaped gas discharge opening.

6. The exhaust assembly of claim 5, wherein said muffler means includes a plurality of lamination-shaped muffler elements arranged in tandem along a longitudinal direction.

7. The exhaust assembly of claim 5, further including a combustion gas feed pipe coupled to said input end of said exhaust tube, and wherein said control means includes means for enabling an operator to selectively operate said control means during use of said exhaust assembly with an operating combustion engine coupled thereto.

8. The exhaust assembly of claim 5, wherein said exhaust tube, said housing and said gas discharge opening are coaxial, and said control means includes a valve mounted inside said exhaust tube and a servo mechanism connected to said valve, said valve selectively moveable between open and closed positions in response to manual operation of said servo mechanism.

9. An exhaust assembly for use with a motor vehicle having a combustion engine, said exhaust assembly comprising:

a combustion engine connection means;

at least one exhaust;

at least one muffler;

a control means for controlling the damping characteristic of said exhaust assembly, whereby the exhaust assembly comprises at least a first combustion gas flow route $V_1$ and a second combustion gas flow route $V_2$, and characterized in that the control means are operable selectively by an operator during use of the exhaust assembly with a combustion engine coupled thereto, and are adapted to divide an approximately constant volumetric flow rate produced by the combustion gases of the engine selectively over the combustion gas flow routes ($V_1$ and $V_2$), irrespective of the volume of combustion gases;

at least one of the gas flow routes comprising damping means, such that the combustion gas flow routes ($V_1$ and $V_2$) have significantly different damping characteristics; and said exhaust assembly further characterized in that the or each muffler comprises a number of lamination-shaped muffler elements arranged one behind the other in the longitudinal direction of the muffler, wherein during use, the flue gases flow between the muffler elements in the direction of the outlet side of the relevant exhaust, wherein the control means comprise switching means for moving at least a number of the muffler elements relative to each other in the longitudinal direction of the muffler, in such a manner that the size of the passages between the muffler elements is adjusted thereby.

* * * * *